United States Patent [19]

Rastelli

[11] Patent Number: 4,955,602

[45] Date of Patent: Sep. 11, 1990

[54] METHOD AND APPARATUS FOR TRAINING IN THE MARTIAL ARTS

[76] Inventor: Gerard Rastelli, 3700 Smith St., Wantagh, N.Y. 11793

[21] Appl. No.: 185,612

[22] Filed: Apr. 25, 1988

[51] Int. Cl.[5] ..... A63B 69/34

[52] U.S. Cl. ..... 272/76; 272/DIG. 5; 273/1 E; 273/1 ES; 273/1 R; 434/258

[58] Field of Search ..... 272/76, DIG. 5; 434/258; 446/334; 273/1 G, 1 F, 1 R, 1 E, 1 ES

[56] References Cited

U.S. PATENT DOCUMENTS

| | | | |
|---|---|---|---|
| 1,564,138 | 12/1925 | Rowland . | |
| 2,984,017 | 5/1961 | Pask | 273/DIG. 28 X |
| 3,024,020 | 3/1962 | Alton | 434/258 X |
| 3,152,805 | 10/1964 | McGinn | 273/1 E |
| 3,871,652 | 3/1975 | Schreier | 272/1 E |
| 3,933,354 | 1/1976 | Goldfarb et al. | 272/76 X |
| 4,088,315 | 5/1978 | Schimmel | 272/76 |
| 4,169,592 | 10/1959 | Hall | 128/782 X |
| 4,358,275 | 11/1982 | Paraghamian et al. | 272/DIG. 5 X |
| 4,508,511 | 4/1985 | McQueen | 434/258 |

FOREIGN PATENT DOCUMENTS

| | | | |
|---|---|---|---|
| 1203258 | 4/1986 | Canada | 272/76 |
| 2725662 | 12/1978 | Fed. Rep. of Germany | 272/76 |

*Primary Examiner*—Richard J. Apley
*Assistant Examiner*—Joe H. Cheng
*Attorney, Agent, or Firm*—Nolte, Nolte & Hunter

[57] ABSTRACT

A method and apparatus for training a person in the martial arts. In the apparatus a display screen has four block-regions. Each block-region has means for rapidly and prominently displaying the word "block". Each region corresponds to a zone on the person's body. An attack-region has means for rapidly and prominently displaying the word "attack". The apparatus has means for displaying each region, one at a time, in a variety of sequences.

In practicing the method, the person observes the apparatus which displays a randomly selected sequence of instructions. Each instruction is either to block one of four zones or to attack. The person responds to each instruction in turn, either by blocking his corresponding zone or by making an attack move.

17 Claims, 4 Drawing Sheets

METHOD AND APPARATUS FOR TRAINING IN THE MARTIAL ARTS

SPECIFICATIONS

The present invention relates to training in the martial arts such as karate, boxing, kung-fu and the like. It relates particularly to a method and apparatus for drilling a person in rapidly selecting and executing appropriate offensive and defensive responses to a variety of unpredictably occurring stimuli.

BACKGROUND

Persons in the martial arts, such as karate, boxing, kung-fu and the like, have as a basic goal the development of split-second reflexes of a physical and a mental nature. Such persons constantly train themselves to be able to perceive, analyze and react to a given situation rapidly. Various means of developing such reflexes have long been known. A martial arts student can practice with a partner or can drill to varied instructions from a teacher. Partners and teachers, however, can telegraph signals, and often develop patterns which are not entirely random, thereby allowing the student to anticipate situations rather than reacting instantaneously to new ones. Partners and teachers also have the disadvantage of not always being conveniently available.

Various inanimate training apparatus have also been devised to develop reflexes but they tend to be bulky, expensive, complicated or ineffective. For example:

Anderson U.S. Pat. No. 4,353,545, issued Oct. 12, 1982 for an ATHLETIC REFLEX MACHINE refers to a martial arts practice apparatus including an upright panel with a plurality of pneumatically actuable strikers, valve-controlled to lash-out toward the user and retract in simulation of weaponless combat.

Goldfarb et al U.S. Pat. No. 3,933,354, issued Jan. 20, 1976 for a REFLEX TESTING AMUSEMENT DEVICE, refers to an amusement device for use in simulating some features of the oriental martial arts. The preferred embodiment comprises a pair of identical pictures of combatants - one picture for each participant. The picture of each combatant camoflages a series of ten lights, each light being located in an attack/defense point on a combatant's body. At the start, one of these ten lights is turned on and the participants each try to hit their light to turn it off. The first hit causes both first lights to extinguish and a second light in each series to illuminate. The player to make the first hit gets a scoring credit for that hit. Attack movements are rewarded by this game. There are no commands to make defensive movements.

Schemmel U.S. Pat. No. 4,088,315, issued May 9, 1978 for a DEVICE FOR SELF-DEFENSE TRAINING, shows a device for use in self-defense training including an articulated training dummy supported in an upright position on a post. The dummy has a plurality of separate pressure receptors disposed at various target locations in the dummy. These receptors are interconnected with signaling means which are remotely located on a display and are adapted to signal by lights when hits are made on the receptors. Programming may be incorporated into the display panel so that the operator can establish a hit sequence.

Lebowitz U.S. Pat. No. 4,564,192, issued Jan. 14, 1986 for a MARTIAL ARTS TRAINING APPARATUS AND METHOD, refers to a training apparatus and a method for training a martial arts student. A pair of simulated arms are designed to strike blows against the student in such a way that requires the student to defend against the blows.

U.S. Pat. No. 4,358,275, issued to Paraghamian et al on Nov. 9, 1982 for ELECTRONIC REACTION TRAINING APPARATUS, refers to a means for presenting individual instructions from a group of predetermined instructions in a random fashion by a random word generator to spell predetermined command word groups in a random fashion. In this device, however, all commands are displayed on a single display and directional cues are in the form of words rather than in the form of commands which appears in different locations. This is in contrast to the present invention, which provides the visual directional cues by presenting its commands from different directions. The Paraghamian device is primarily intended for use in hospitals for physical therapy associated with the rehabilitation of patients. While mention is made of use in athletic fields, there is no teaching as to how it can be used in the present type of martial arts drill.

It is an object of the present invention to provide a method and apparatus for developing split-second reflexes of a physical and mental nature by training a person or student to be able to perceive, analyze and react to a given situation in a split-second. It is another object of the present invention to provide a simple, low-cost, convenient machine to train a person's mind to react as one with his body in a way that will minimize the temporal gap between thought and reaction.

SUMMARY OF INVENTION

For purposes of defense in the martial arts, the human body is divided into four zones. The body is divided vertically down its center and horizontally across its chest. All martial arts use different kinds of blocks to guard these zones. As a prerequisite to this present drill, the subject will be trained in the various blocks which will guard these zones.

The apparatus of the present invention comprises a box approximately 12 inches by 12 inches on one side, having screen means for display of drill commands such as a display screen on that side. The screen is divided into four block-regions, each occupying approximately a 5 inch by 5 inch corner of the box. Behind each region is disposed a lamp means, preferably comprising a yellow incandescent light bulb. The word "block" is printed on each of these four regions or areas of the display screen. Each region corresponds to one of the four defense zones of the human body. A central attack-region of the display screen, located between the upper block-regions and the lower block-regions, comprises a 2 inch by 5 inch area behind which is disposed a lamp means, preferably a red incandescent light bulb. The word "attack" is printed on this central region of the screen.

Means for selecting and varying a frequency of sequencing, from a lowest frequency, through a plurality of higher intermediate frequencies, to a highest frequency, comprises a speed knob located to one side of the attack light. On the other side of the attack light is located switch means for varying the sequence in which the regions illuminate to display their commands so that such sequence can take on a plurality of patterns. In the preferred embodiment, six modes are available through a four-button mode switch apparatus. This switch has three buttons which regulate which lights go on and in what pattern they sequence. A fourth button regulates rhythm. To use the machine, one or more persons stand in a position to observe the screen at a distance which makes contact with the screen unlikely, such as six feet. A first light will go on. If such first light is a yellow light, it is intended to simulate an attack being directed to the zone of the person's body corresponding to the lighted region on the display screen. The person then performs a blocking maneuver which would protect that zone of his body. If the red light goes on, it is intended to simulate an opening. The person responds by throwing a punch or a kick. Each light remains illuminated for a period depending upon the selected frequency and is followed by another light depending upon both the selected pattern and upon the selection of a randomness generator.

It is an advantage of the present invention that neither a partner nor an instructor is required for the performance of reaction drills. Another advantage is that it is impossible for the person to anticipate the next command from the apparatus. It is a further advantage that the present invention can be produced at relatively low cost and without moving or mechanical parts. Other advantages are that it is easily maintained, that it does not occupy a large quantity of space, that it will not suffer excessive wear and tear in use, that it is not intended to suffer impact from its users, that its speed can be adjusted according to the needs and abilities of the users, that it is easy to store, that it can direct the user to a variety of drills and that it develops both attacking and blocking skills.

DETAILED DESCRIPTION OF A PREFERRED EMBODIMENT

Figure 1:
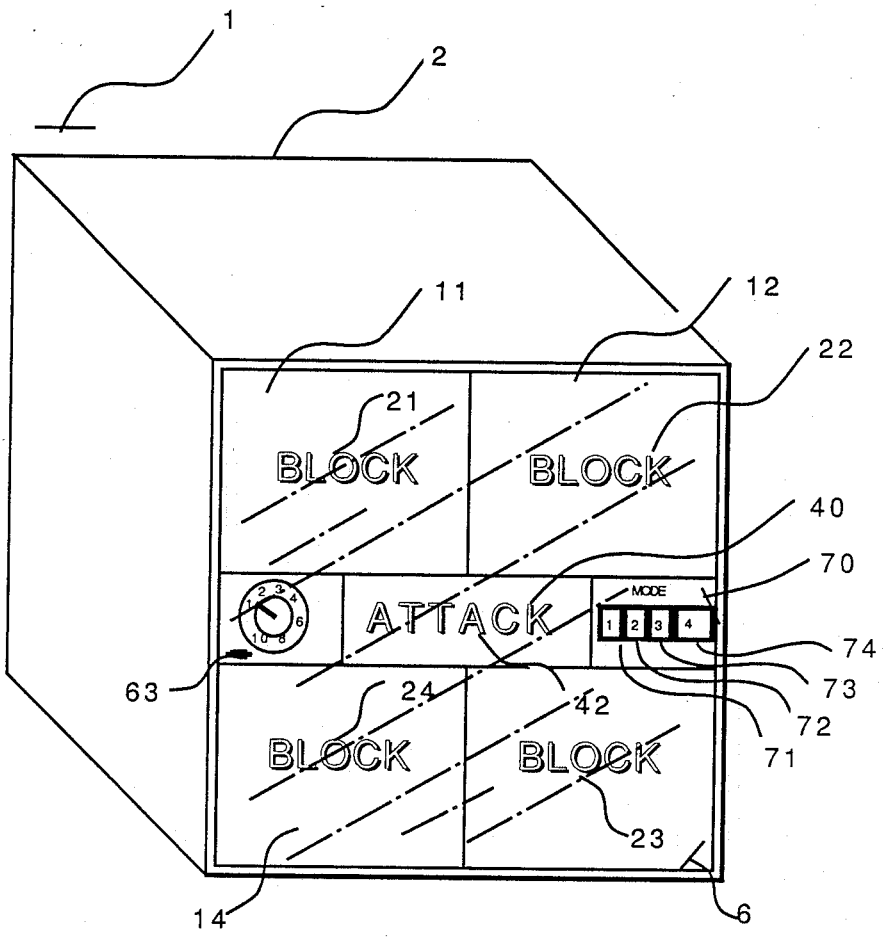
FIG. 1 is an oblique view of the apparatus of the present invention.

As shown in FIG. 1, the apparatus of the present invention, generally designated 1, comprises a box-like housing 2 made of wood, metal or plastic. One side of the housing 4 is a square of approximately one foot and is mainly occupied by screen means for display of drill commands, such as display screen 6. Display screen 6 has four block-regions 11, 12, 13, 14. Each block-region has means for rapidly and prominently displaying therein means for commanding a person to block.

The means for commanding the person to block preferably comprises the word "block" 21–24 printed on one side of the translucent material, such as plastic, which comprises display screen 6.

Figure 2:
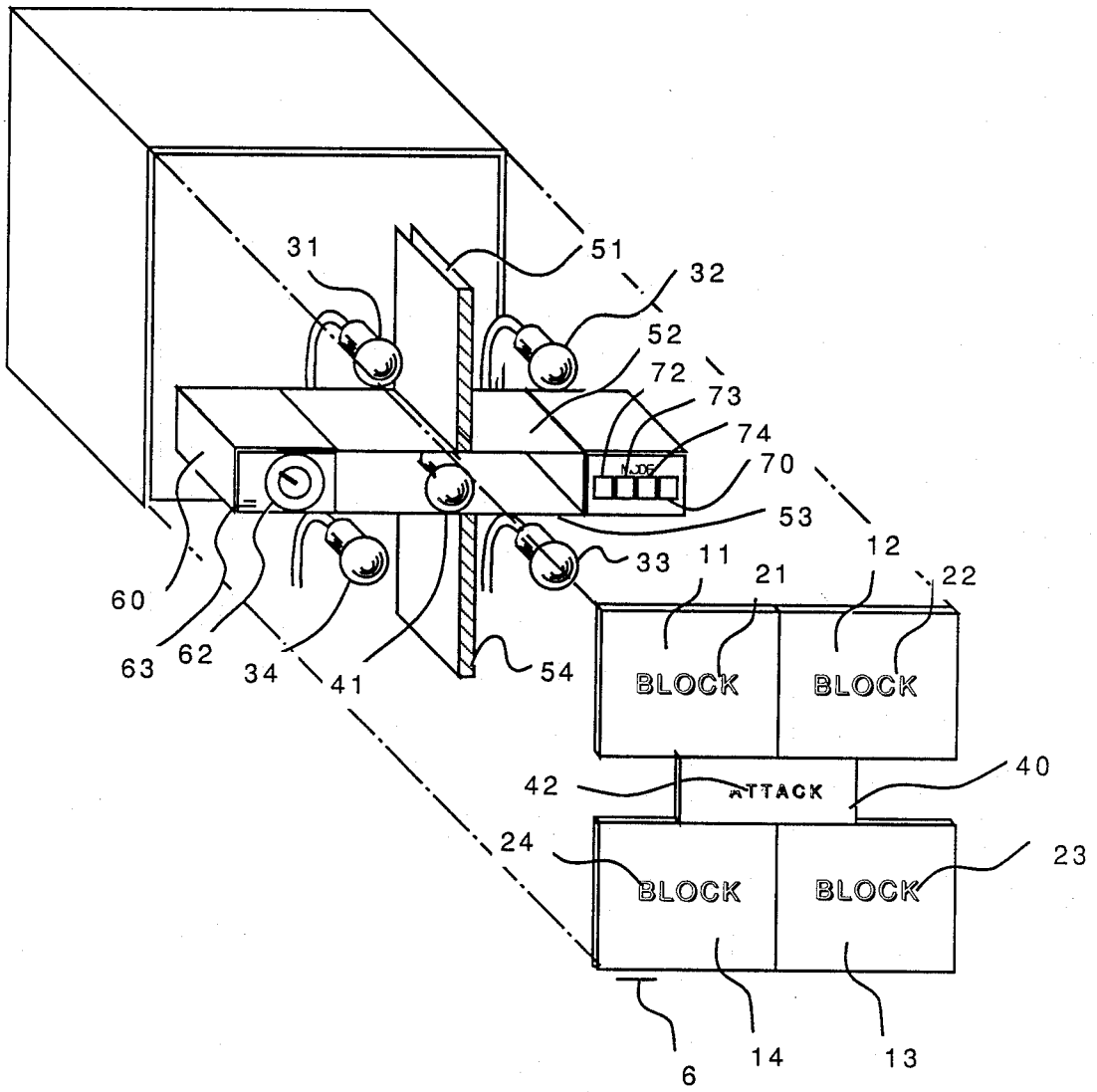
FIG. 2 is an oblique exploded view thereof.

FIG. 2 shows lamp means such as light bulbs 31–34. Each light bulb comprises means for rapidly and prominently displaying the word "block" 21–24 by illuminating it from behind so that it becomes highly visible to a person facing display screen 6.

Thus, the block-regions comprise an upper-left block-region 11, an upper-right block-region 12, a lower-left block-region 14 and a lower-right block-region 13.

Attack-region 40 is also provided toward the center of display screen 6. Attack-region 40 has means for rapidly and prominently displaying means for commanding a person to attack. Said means, for rapidly and prominently displaying, comprises lamp means such as light bulb 41 shown in FIG. 2 disposed behind means for commanding a person to attack, such as the word "attack" 42 which is printed upon the back of attack region 40 in a manner similar to the word "block" 21–24.

In order to further distinguish an attack command from a block command, the block-regions will display in a first color, by means of using yellow light bulbs 31–34, and the attack regions in a second color, by means of using red light bulb 41.

Baffle means comprising internal walls 51, 52, 53 and 54 isolate the light of each light bulb from all words except the word behind which that light bulb is disposed. In one embodiment, the display screen can be a translucent material with the words printed on its inside face in opaque letters. Thus, the printing is normally invisible, but, when each lamp is illuminated, each word will show dark against the illuminated backdrop. Alternatively, the opaque coating can be applied to the entire screen except for where the illuminated word is to shine through. Or, the word can as easily be printed on the outside face of the display screen as shown.

The apparatus has means 60 for displaying each region in sequence. Sequencing means 60 supplies power through wires to light bulbs 31–34 and 41, illuminating them, one at a time, in sequence. This comprises means such as frequency knob 62 for selecting and varying a frequency of sequencing from a lowest frequency to a plurality of higher intermediate frequencies to a highest frequency.

Sound generating means, such as beeper 63, can be coupled to the sequencing means, for cueing the person to each new command.

Figure 3:
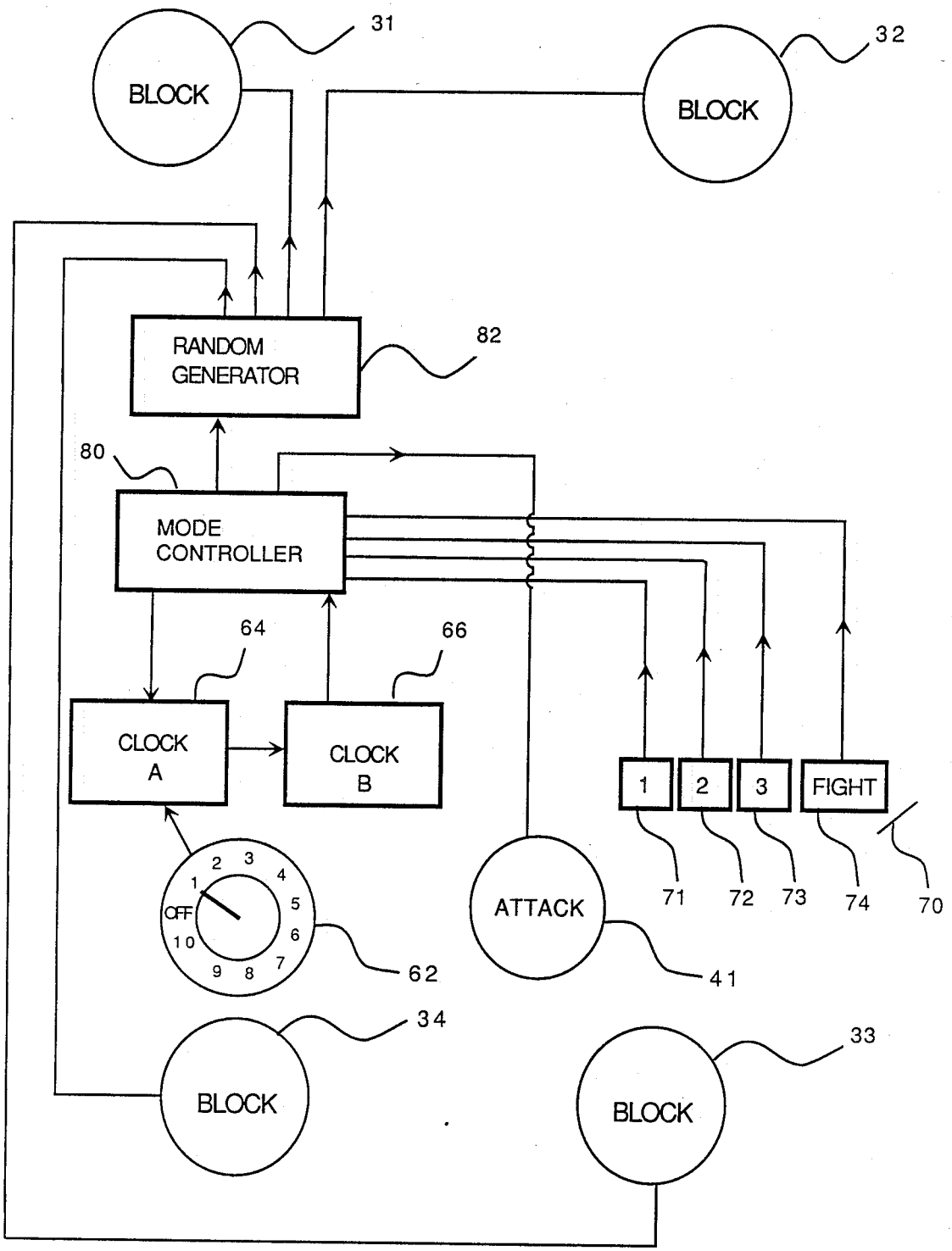
FIG. 3 is a block diagram of components thereof.

As shown in FIG. 3, there is also means for automatically initiating a drill at a lowest sequencing frequency and increasing sequencing frequency gradually until a preselected higher sequencing frequency is achieved. Once the higher sequencing frequency is achieved, it is maintained. In practice, this can be accomplished by a pair of clocks or clock registers. (FIG. 3) When frequency selector switch 62 is advanced from the off position to a selected frequency, the first clock begins counting a first interval during which it tells the second clock to sequence over a fairly long sequencing interval such as one second. After a first warmup interval, such as ten seconds, has elapsed, clock A 64 tells clock B 66 to sequence at a shorter sequencing interval, such as .8 seconds. The second warm-up interval, such as ten seconds, is followed by a third warm-up interval during which clock B 66 sequences at an even shorter sequencing interval until the preselected interval is achieved. At that point, clock A 64 ceases to advance or shorten the interval of clock B 66 and a consistent sequencing frequency is maintained.

Also included is a means, such as mode selector switch 70 (FIGS. 1–3), for varying the sequence in which the regions display to provide a plurality of patterns. Mode selector switch 70, includes mode buttons 71–74.

The pressing of button 71 (FIG. 3) actuates a block-only pattern in which mode controller 80 actuates random generator 82 to flash only the yellow block lights 31–34, one at a time, in a random sequence. This mode is well-adapted for beginners learning the basics of blocking.

Depressing punch-block button 72 actuates a mode in which mode controller 80 alternately:

actuates attack-light bulb 41, and
actuates random generator 82.

When random generator 82 is actuated, it randomly actuates one of the four block-light bulbs 31–34. Thus, punch-block routine button 72 comprises and actuates means for generating a punch-block routine pattern in which a randomly selected block-region displays alternately with an attack-region at a sequencing frequency dictated by clock B 66 as described above.

Depressing random-even button 73 generates a random, even pattern in which all regions are displayed in a random sequence. In this mode, mode controller 80 randomly selects either the actuation of attack light 41, on approximately fifty percent of its choices, or random generator 82, which randomly selects one of the block lights 31–34 and actuates it.

Depressing fight-mode button 74 creates a fight-mode rhythm, in any of the above routines. The fight-mode breaks the rhythm of sequencing. In this mode, mode controller 80 will randomly decline to actuate either random generator 82 or attack-light 41 for randomly selected intervals at randomly selected points in the sequence. Thus, if switch 74 is pushed, the fight-mode is actuated and the light rhythm becomes staggered. For example: light, [. . .] break, light, light, light, [. . .] longer break, light, light, [. . .] break, light, light, light, etc. This mode is described as a fight mode because, in a fight, an even rhythm of blows and blocks never occurs. There are always punches thrown, then a break, punches, break, etc., for varying intervals of attack and then rest.

By varying the rhythm with button 74 between basic and fight, and varying the light pattern with switches 71-73 between punch-block, block-only and random-even, six different drills can be selected.

METHOD

Figure 4:
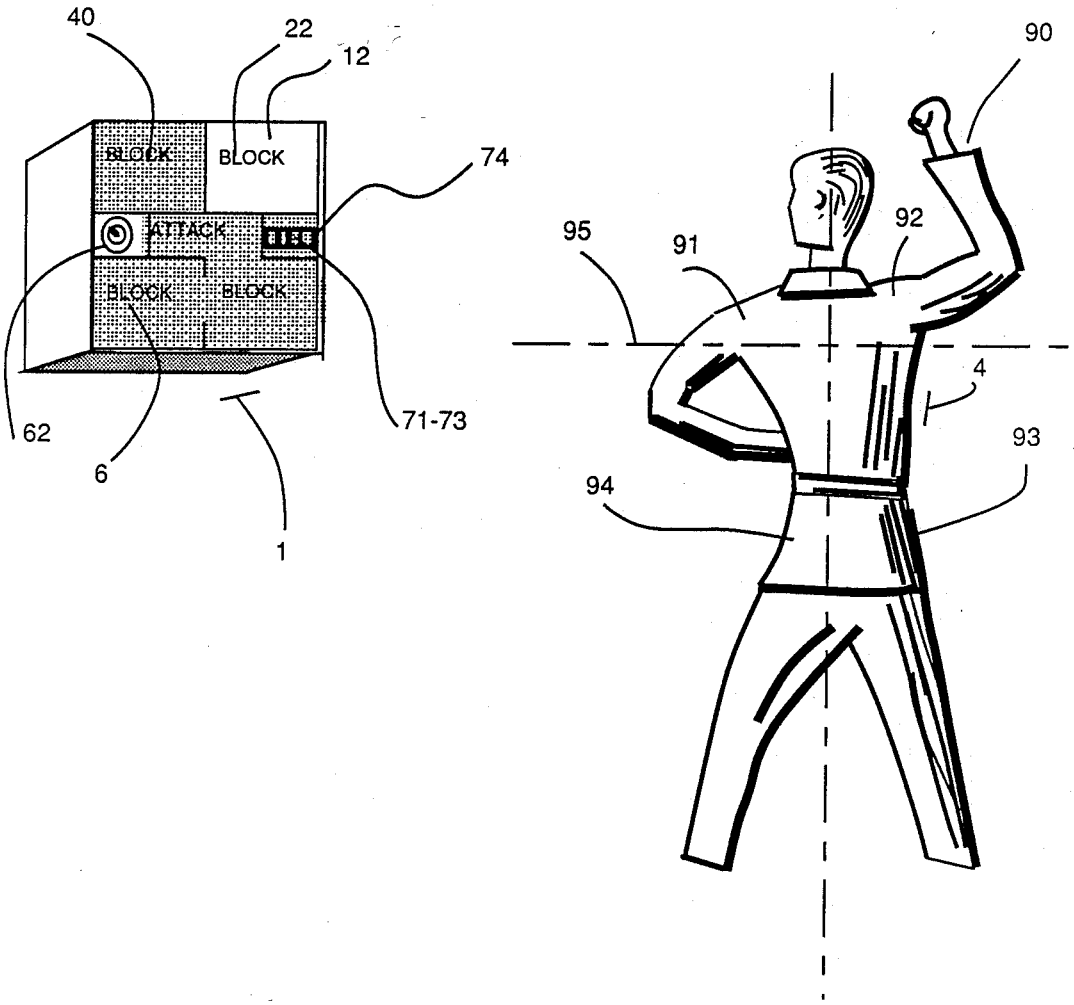
FIG. 4 is a front oblique view of the apparatus and a rear oblique view of a person using the method and apparatus of the present invention.

Using the machine comprises the following steps (FIG. 4):

The person to be trained 4 must first have learned blocking actions to protect the four zones 91–94 of his body and must have learned at least one attack movement. Apparatus 1 is hung on a wall at about chest level 95. The apparatus is turned on to a desired speed setting using frequency selector knob 62. The rhythm mode is set by either:

leaving the mode button 74 in a non-actuated position for an even rhythm, or
actuating mode button 74 for a staggered (fight) rhythm.

The desired pattern is selected by depressing one of buttons 71–73. Person 4 stands about six feet away from apparatus 1.

Lights will begin flashing one at a time at a slow frequency and then sequence gradually faster for about thirty seconds, as the frequency builds to the preselected setting.

When the attack-light illuminates region 40 to display the attack command, the person performs one of his repertoire of attack moves. When one of the four block-lights illuminates a block-region, to display a block command, person 4 performs a blocking move to protect a corresponding zone of his body. For example, when a block-light illuminates blockregion 12 in the upper righthand corner of display screen 6, and displays "BLOCK" command 22, person 4 will raise his right arm 90 to block an imaginary punch from that direction to that zone 92 of his body.

I claim:

1. A martial arts training apparatus comprising:
screen means for display of martial arts drill commands;
said screen means having four block regions, each block region having means for rapidly and prominently displaying therein means for commanding the person to block;
an upper left block region disposed in an upper left portion of the screen means;
an upper right block region disposed in an upper right portion of the screen means;
a lower left block region disposed in a lower left portion of the screen means;
a lower right block region disposed in a lower right portion of the screen means;
an attack region, disposed upon the screen means intermediate said block regions, having means for rapidly and prominently displaying means for commanding the person to attack;
and means associated with the screen means for:
selecting a predetermined martial arts drill command sequence,
automatically displaying the means for commanding in each region for an interval,
automatically terminating said interval,
automatically displaying another means for commanding in sequence for another interval, and
automatically displaying and terminating the means for commanding without contact by the person.

2. Apparatus according to claim 1 in which the attack region is disposed toward a center of the screen means.

3. Apparatus according to claim 1 wherein said means associated with the screen means further comprising control means for selecting and varying a varying clock means, said varying clock mean for varying a frequency of sequencing.

4. Apparatus according to claim 3 further comprising:
said control means for automatically initiating a drill comprising a sequence of drill commands upon the screen means at a lowest sequencing frequency, and
varying clock means responsive to said control means for increasing a sequencing clock controlled sequencing frequency gradually until a preselected higher sequencing frequency is achieved, and means associated with said sequencing clock for maintaining said higher sequencing frequency for a remaining

5. Apparatus according to claim 4 wherein said means associated with the screen means further comprises means associated with the control means for varying the sequence of display, said sequence varying in a plurality of patterns of drill commands; and means for randomly varying an order of displaying each drill command.

6. Apparatus according to claim 5 comprising means associated with the sequencing clock for displaying on the screen means a fight mode rhythm, wherein said fight mode rhythm includes intervals of pseudorandom occurrence and duration, during said intervals no region is displayed.

7. Apparatus according to claim 5 comprising means for displaying on the screen means a punch block routine pattern, wherein said punch block routine pattern randomly selected a block region displays alternately with the attack region.

8. Apparatus according to claim 5 comprising means for displaying on the screen means a block only pattern, wherein said block only pattern only block regions are displayed in a random sequence.

9. Apparatus according claim 5 comprising means for displaying on the screen means a random even pattern, wherein said random even pattern all regions are displayed, one region at a time, in a random sequence at an eventually constant sequencing clock controlled frequency.

10. Apparatus according to claim 5 comprising means for displaying on the screen means a plurality of drill command patterns comprising:

a "block only" pattern in which pattern only block regions are displayed in random sequence;

a "punch block routine" pattern in which pattern a randomly selected block region displays alternately with the attack region; and a "random even" pattern in which pattern all regions are displayed in a random sequence at an eventually constant sequencing clock controlled frequency.

11. Apparatus according to claim 10 further comprising means for sequencing a display on the screen means in two rhythms comprising:

a basic rhythm in which rhythm a region is displayed during each sequence of one of said plurality of drill command patterns; and a "flight mode" rhythm in which rhythm the sequence includes intervals, of pseudorandom occurrence and duration, in which intervals no region is displayed.

12. Apparatus according to claim 5 wherein said screen means is a sheet of translucent material.

13. Apparatus according to claim 12 wherein each means of rapidly and prominently displaying on the screen means comprising:

a word printed upon each respective region of said screen means; and lamp means, disposed behind each respective region of said screen means for illuminating said word.

14. Apparatus according to claim 13 wherein the block regions display on the screen means in a first color and the attack region displays on the screen means in a second color.

15. Apparatus according to claim 14 wherein each means for commanding the person to block comprises the word "BLOCK" printed on the screen means.

16. Apparatus according to claim 15 wherein the means for commanding the person to attack comprises the word "ATTACK" printed on the screen means.

17. A method of training a person in martial arts, using an apparatus having a plurality of drill commands, each command disposed in its own region of a screen means for displaying of said drill commands, said commands comprising four commands to block and one command to attack, each block command located in a corner of the screen means, each corner corresponding to a defensive zone on the person's body, the method comprising the steps of:

displaying on the apparatus for a first interval a first drill command;

automatically terminating display on the apparatus of the first drill command at an end of the first interval;

automatically displaying on the apparatus a second drill command for another interval;

automatically terminating display on the apparatus of the second drill command at an end of its interval;

continuing the automatic display and terminating of drill commands on the apparatus for the duration of a training session;

observing the apparatus; and attempting to respond to each drill command displayed on the apparatus by making an appropriate movement, remote from the apparatus.

* * * * *

UNITED STATES PATENT AND TRADEMARK OFFICE

CERTIFICATE OF CORRECTION

PATENT NO. : 4,955,602

DATED : 9/11/90

INVENTOR(S) : Gerard Rastelli

It is certified that error appears in the above–identified patent and that said Letters Patent is hereby corrected as shown below:

In column 6 of the printed patent at line 49, after "remaining" there printed should be --duration of the drill.--.

Signed and Sealed this

Twenty-eighth Day of January, 1992

*Attest:*

*Attesting Officer*

HARRY F. MANBECK, JR.

*Commissioner of Patents and Trademarks*